United States Patent [19]

Bellaire

[11] Patent Number: 4,850,156

[45] Date of Patent: Jul. 25, 1989

[54] METHOD OF IMPREGNATING POROUS ABRASIVE ELEMENTS FOR USE IN DISTRESSING FABRICS

[76] Inventor: David L. Bellaire, 1701 W. El Caminito, Phoenix, Ariz. 85021

[21] Appl. No.: 118,167

[22] Filed: Nov. 9, 1987

[51] Int. Cl.[4] ..... B24D 3/00

[52] U.S. Cl. ..... 51/293; 51/296

[58] Field of Search ..... 51/296, 293

[56] References Cited

U.S. PATENT DOCUMENTS 4,086,067 4/1978 Busch et al. ..... 51/296

4,581,287 4/1986 Smith et al. ..... 51/296

*Primary Examiner*—Paul Lieberman

*Assistant Examiner*—Willie J. Thompson

*Attorney, Agent, or Firm*—Nelson & Roediger

[57] ABSTRACT

A method of preparing porous abrasive rock for use in distressing fabric, including the steps of impregnating rocks placed in a vacuum vessel with a bleaching solution under reduced pressure, maintaining the reduced pressure for a first interval while injecting the solution beneath the rocks and then increasing the vessel pressure above ambient for a second interval prior to removal.

14 Claims, 1 Drawing Sheet

FIG. 1
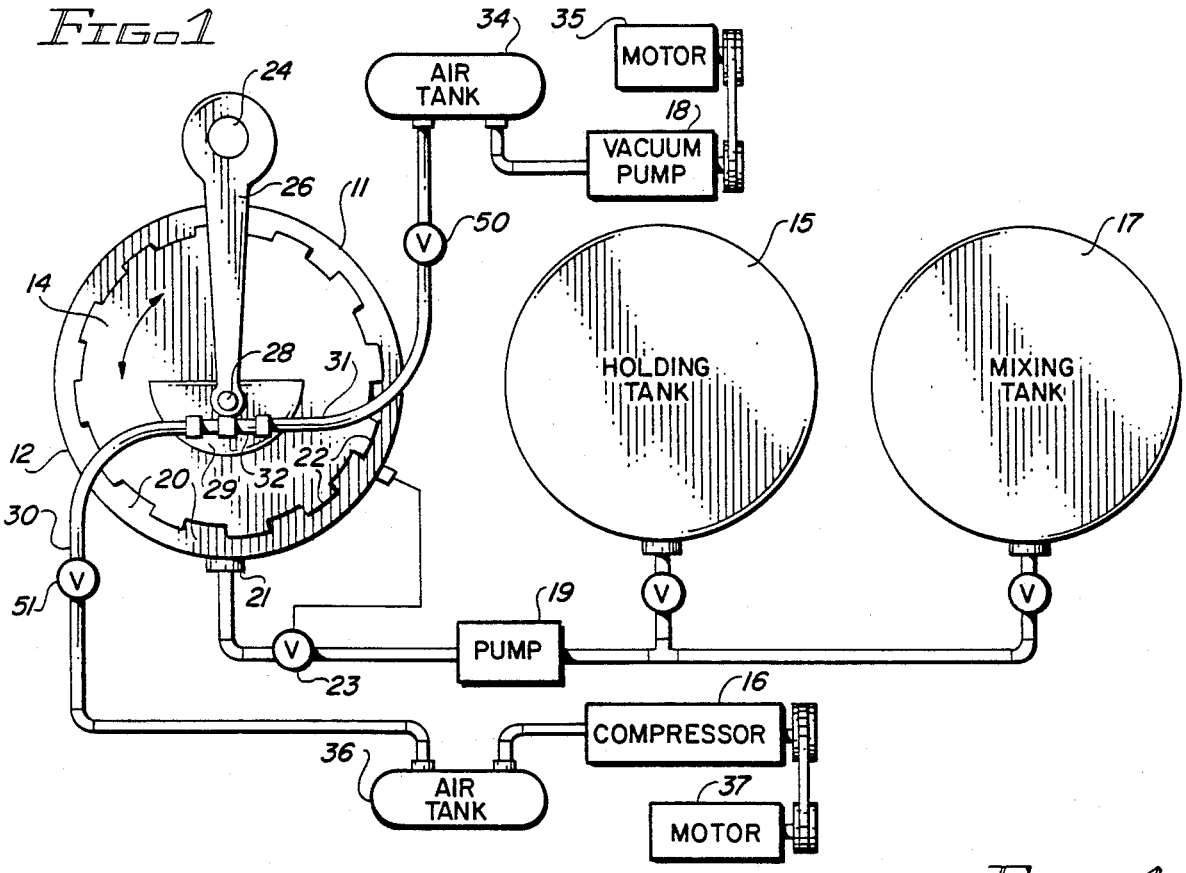
FIG. 4
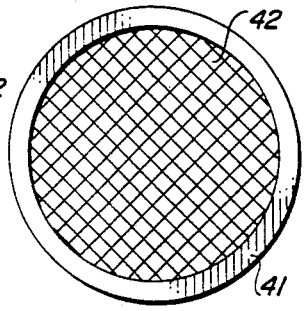
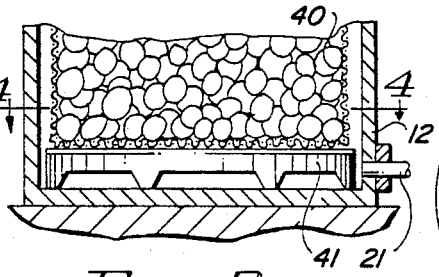
FIG. 3
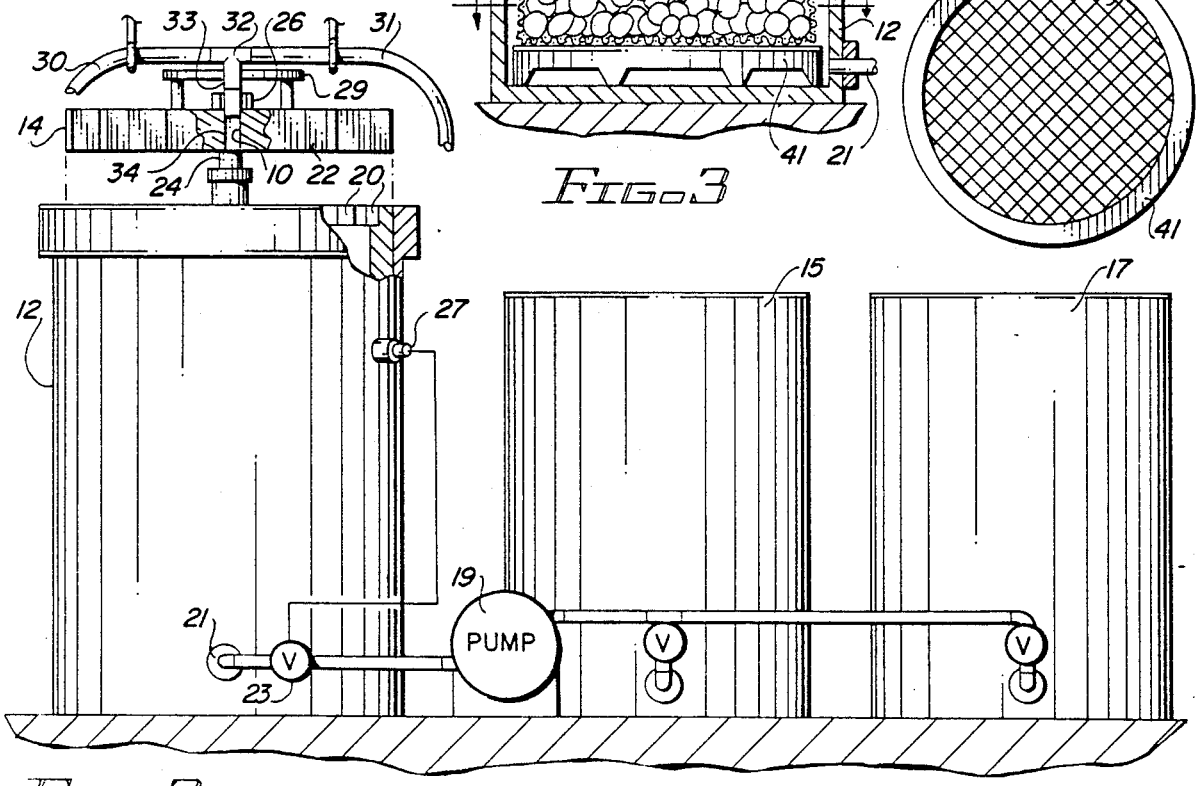
FIG. 2

METHOD OF IMPREGNATING POROUS ABRASIVE ELEMENTS FOR USE IN DISTRESSING FABRICS

BACKGROUND OF THE INVENTION

This invention relates to a method for impregnating porous abrasive elements with a reactive solution for use in distressing fabrics and, in particular, to be utilized in a tumbling environment with denim fabric.

In recent years, the fashion industry has seized upon the use of cotton denim fabrics as fashionable materials. While the history of blue denim fabrics has coincided, to a degree, with that of the rural areas of this country, the popularity of garments made from this fabric has extended throughout the country. Since these fabrics have been traditionally stiff, pretreatment of fabricated garments to achieve a softening as well as a prefading indicative of long term use have been found to be commercially beneficial to the marketer of the garment. In addition, a substantial market has been created for intentionally distressed, prefaded and softened denim garments. In order to pretreat or precondition these garments to an acceptable distressed look in what are otherwise new garments, the industry has sought to develop low cost and reliable preconditioning processes.

Initial interest in the industry was directed to what is called a prewashing process, which preshrinks the garment and is conducted in water, to utilize the well-known tendency of cotton fabrics to change dimension. The next step in the preconditioning sequence has been the introduction of stone-washing utilizing rocks in a tumbling apparatus to, in effect, prewear the garment in a random or unpredictable pattern. This process utilized a soft stone, typically a volcanic such as pumice. Since the fashion industry is never static, attempts were made to introduce additional processing steps which would further distinguish garments so treated from those in vogue during the prior season. As a result, the industry has recently introduced denim fabric garments which have been subjected to a rifling process. This process combines the abrasive action of the stone-washing process, along with the introduction of a reactive solution such as a bleach. Typically, conventional chlorine bleaches, wellknown in the industry, have been utilized.

At present, a substantial portion of the pretreated denim fabrics are subjected to a rifling process utilizing a porous volcanic with abrasive characteristics and which has been sprayed, coated or otherwise provided with a surface-region infusion of chlorine bleach. The operating lifetime of the volcanic rock is limited since it is subjected to continuous tumbling until it disintegrates sufficiently so that the fines in the tumbling machinery detract from the abrasive action of the solids and the mass of rocks decreases so as to cease abrading the fabric. In addition, the amount of bleach provided with each of the porous rocks is limited to the surface or near surface environment so that as erosion of the volcanic rock takes place, the amount of chlorine available to contact the fabric has greatly diminished and the desired result is not achieved. As a result, the operating cycle for the present processes is unduly limited.

Accordingly, it is a primary object of the present invention to provide an improved porous abrasive element for use in the preconditioning of fabrics. Also, the invention is directed to the increase of the amount of bleaching agent or conditioning material contained in the abrasive elements so as to increase the time interval between replacement thereof. Another objective of the invention is to utilize conditioning materials which are more effective than the conventional chlorine bleaches so that the resultant distressing is more visually noticeable in the treated garment. The present invention is further concerned with a process for providing abrasive elements of increased effectiveness and longer operating lifetime by utilizing an operating process which is easy to operate, low in cost and possesses a high capacity for treatment.

SUMMARY OF THE INVENTION

This invention relating to a method for impregnating porous abrasive elements for use in the intentional distressing of fabric comprises a sequence of steps including the placement of a quantity of the porous abrasive elements in a vacuum vessel. The pressure in the vessel is then reduced to a first pressure which is less than ambient atmospheric pressure and this pressure is maintained while a reactive solution is introduced into the vessel to a level sufficient to cover the porous elements.

The reactive solution is preferably a potassium or sodium permanganate solution which is a strong bleaching agent. If desired, a suitable dying solution can be utilized in its place. The first pressure is maintained for at least as long as the time required to introduce the reactive solution in the vessel and cover the porous elements. The low pressure in combination with the introduction of the solution from near the base of the vessel has been found to result in substantially the entire pore volume of the elements being impregnated. To further promote impregnation, the low first pressure can be maintained for an interval after the introduction of the active solution.

When the solution has been introduced into the vessel, the pressure therein is restored to approximately ambient level and the impregnated elements are removed therefrom. In practice, the impregnated elements are surface dried to facilitate handling and are then transported to the tumbling equipment wherein the fabric to be distressed is located.

The tumbling process is normally conducted with an initially damp fabric to promote the chemical reaction with the reactive solution and no other liquids are added during the distressing process. Conventional techniques and equipment are utilized in the tumbling process and thereafter. These may typically include a following wash with a reducing agent or neutralizer such as sodium meta bisulfite.

The present process has been found to result in the preparation of porous elements wherein the pores are essentially filled with liquid throughout the entire volume. As a result, the tumbling or processing lifetime of the elements is substantially greater than present processes which result in the porous elements containing reactive solutions only in the regions proximate to the surface thereof. Further features and advantages of the present invention will become more readily apparent from the following detailed description thereof when taken in conjunction with the accompanying drawings.

BRIEF DESCRIPTION OF THE DRAWINGS

FIG. 1 is a plan view of one embodiment of apparatus suitable for use in performing the present invention.

FIG. 2 is a side view of the embodiment of FIG. 1.

FIG. 3 is a partial cross-section of the vacuum vessel shown in FIGS. 1 and 2.

FIG. 4 is a cross-sectional view taken along line 4—4 of FIG. 3.

DESCRIPTION OF THE PREFERRED EMBODIMENT

The present invention comprises a sequence of steps directed to the making of porous abrasive elements containing a reactive solution throughout the pore volume thereof to be used in the treatment of fabric and is practiced in apparatus of the type shown in the drawings. The resultant product is normally utilized in tumbling apparatus of conventional design to abrade, bleach and otherwise distress the fabric therein in a random pattern.

In FIG. 1, a vacuum vessel 11 containing an outer wall 12 which is preferably part of a double wall vessel with a removable cover 14 is shown connected to multiple sources or reservoirs of reactive solution 15, 17. In addition, the cover 14 is provided with a port 10 suitably coupled through valves to a vacuum pump 18 and compressor 16. Thus, the pressure within the vessel 11 is controlled by the actuation of the individual valves connecting vacuum pump 18 and compressor 16 to the vessel via port 10. The cover is fittedly received beneath inwardly extending segments 20 and is provided with an outline that corresponds to the size and spacing of the segments 20 affixed to outer wall 12 of the vessel. The cover 14 is provided with corresponding segments 22 which allow removal of the cover 14 from the vessel when segments 20 and 22 and spaces therebetween are in adjacent registration as shown in FIG. 1. In order to secure the cover 14 to the vessel, the handle 29 is grasped by the operator to move the cover above the opening in the vessel followed by rotation about retaining pin 28 to provide a locking feature with the double wall vessel.

Support arm 26 is affixed to cover 14 at pin 28 and imparts vertical movement thereto upon the actuation of an external hydraulic cylinder having its ram 24 attached to the outwardly extending portion of arm 26. In addition, the combination of arm 26 and ram 24 are rotatable within the hydraulic system in the direction of the arrows so as to permit the cover to be rotated thereby permitting access to the inside of the vessel. This movement can be effected by the operator utilizing handle 29 since the weight of the cover lid 14 is borne by arm 26.

A T-shaped coupling member 32 with flexible hoses 30 and 31 extending outwardly therefrom includes a vertical stem 33 connected to a passageway 34 in cover lid 14. Hose 30 is coupled via a valve 51 to air tank 36 and thence to compressor 16 linked to motor 37. The flexible hose 31 oppositely coupled to member 32 is coupled via valve 50 to an air tank 34 which in turn is coupled to vacuum pump 18 driven by motor 35. The sequence of actuation of the vacuum pump 18 and compressor 16 control the pressure within the vessel 11 during operation.

The constructional features of the handle 29 and the T-shaped coupling member 32 with associated flexible hoses 30, 31 are shown in further detail in the side view of FIG. 2 wherein the peripheral location of segments 22 of cover lid 14 are shown. The elevation of the handle and cover occurs from the movement of ram 24 in its hydraulic cylinder which also provides the axis for rotation of the cover lid 14 when it is to be directed out of the way and the vessel 11 is to be loaded or unloaded with porous elements. The handle 29 is shown in section containing the vertical portion 33 of coupling member 32 extending therethrough. A partial cutaway portion of vessel 11 is shown in FIG. 2 highlighting the location of the segments 20 in wall 12 and the double wall construction. The foregoing vacuum vessel is representative of apparatus which may be utilized in the practice of the present invention.

The reactive solution to be utilized in the present process is shown in FIGS. 1 and 2 as being contained in reservoir or holding tank 15. A mixing tank 17 is connected through valving to the same pump 19 as holding tank 15. It is to be recognized that as one tank is emptied, the other of the tanks becomes the holding tank for purged fluid, if desired. The fluids in the tank utilized in the process at the moment are supplied into the vessel 11 at input port 21 located proximate to the bottom of the tank. Valve 23 controls the flow of fluid into vessel 11 and is electrically coupled to level sensor 27 inserted in a pressure tight fitting in the walls of vessel 11. Thus, the height of fluid in the vessel is directly controlled from within the vessel itself. The valve at the holding and mixing tanks are manually operated based on the operator's assessment of which tank is to supply the vessel during a particular operation.

The porous elements, typically volcanic rock or pumice, to be loaded into the vessel are contained in a wire basket 40, shown in part in FIG. 3, which is top loaded, typically by an overhead loading assembly, directly under the control of the operator. The basket is loaded and unloaded at locations remote from the vessel 11. A stand 41 dimensioned to fit within the vessel 11 and containing a central mesh area to permit the passage of fluid therethrough is shown in plan view in FIG. 4. The mesh 42 supports the mesh basket 40 containing the porous elements therein and stand 41 elevates the basket above the bottom member of vessel 11. The input port 21 formed in sidewall 12 is shown in FIG. 3 positioned beneath the level of the mesh 42 of stand 41 so that fluid entering the vessel moves upwardly through the supported porous rocks until such time as it reaches the level sufficient to cause sensor 27 to close valve 23 and cease the filling operation.

In operation, the present process is conducted by having the cover 14 rotated away from the wall 12 to permit access to the interior of vessel 11. The basket 40 is filled with the porous elements to be treated and transported to a position overlying the vessel and lowered to rest upon stand 41. The operator detaches the hoist assembly and causes it to be moved out of the way. Next, the cover lid 14 is rotated about the axis of ram 24 to overlie the opening in vessel 11 with the segments 20 and 22 in appropriate adjacently registered position. The hydraulic mechanism is then actuated so that the cover lid 14 moves vertically downward into position as part of the vessel with the operator then grasping the handle 29 to provide a degree of rotation causing the segments to lock one below the other and provide a pressuretight fit between cover lid 14 and wall 12.

In preparation for the practicing of the present invention, an aqueous solution of a permanganate, either potassium or sodium, is prepared and stored in one or both of tanks 15, 17. This reactive solution is normally mixed within the tank and appropriate agitation means can be incorporated in the tank if desired. In practice, the percent of permanganate added is within the range of 1–5% by weight of solution. Since the effect to be produced on the fabric treated with the porous rocks treated in accordance with the present invention varies based on the dictates of fashion, the strength and composition of the reactive solution can be altered in accordance with the result desired. The permanganate aqueous solution is readily prepared at ambient temperature although a heated solution could be utilized if other components were added to produce different visual effects on the fabric so treated. The porous, abrasive elements which are to be impregnated with the reactive solution are loaded in the mesh basket at a site and the basket is elevated and placed within the vessel 11 so as to rest upon stand 41. The cover lid 14 is then rotated and lowered into position and locked to provide a pressure-tight vessel. At this time the pressure within the vessel is equal to the atmospheric pressure.

To initiate the operation, the operator activates motor 35 and vacuum pump 18 to lower the pressure in air tank 34. As shown, the air tank is coupled through a valve 50 which is open to reduce the pressure in vessel 11 to a level below that of the ambient pressure. This pressure drop is within the range of 12–14 pounds per square inch below atmospheric pressure and upon reaching this reduced pressure level, valve 23 is opened and pump 19 actuated to supply the reactive solution to vessel 11. The vacuum pump 18 maintains the desired pressure level in tank 34 so that the evacuation through port 10 in cover 14 continues during the introduction of the reactive solution. This permits the reduced pressure to be maintained during filling of the vessel 11. Filling continues until the reactive solution level reaches the level sensor 27 which then closes valve 23 connected in the feed line through input port 21 to vessel 11. The wire basket 40 is filled with porous elements to a level that does not exceed the liquid level established by sensor 27. As a result, the entire volume of porous elements is covered in vessel 11 by the reactive solution. During this step, the vacuum pump 18 continues to maintain the desired low pressure level in tank 34 so that the pressure within the vessel 11 remains at the reduced level. While it is then possible to deactivate the compressor and begin restoring pressure within the vessel to approximately the ambient level, it is preferred to maintain the reduced pressure for a short period, typically less than 15 minutes. The porous elements have had their pore volumes evacuated by the reduced pressure in vessel 11 so that the reactive solution rising from the bottom of the vessel can then occupy the pore volume. The maintenance of a reduced pressure of 12.25 psi below atmospheric pressure for a limited period after filling the vessel to its desired level has been found to materially aid the impregnation process of the porous elements.

After this low pressure interval, pump 19 is reversed to begin the removal of the reactive solution from vessel 11. At the same time, valve 50 has been closed and valve 51 is opened to permit the flow of air from tank 36 into vessel 11. The reservoir tank 36 is coupled to compressor 16 which maintains a pressure therein at a level slightly above ambient pressure. The introduction of air at this elevated pressure assists in the removal of the reactive solution from vessel 11 through the bottom port 21 and also is believed to enhance the impregnation of the porous elements with the reactive solution. In practice, the process has utilized a 10–15 pounds per square inch above ambient pressure to provide the desired results. Upon the purging of the reactive solution from vessel 11, the compressor 16 is deactivated to permit the pressure in air tank 36 to reach ambient level which thus causes the pressure in vessel 11 to also reach ambient or atmospheric level. Next, the locking process of cover lid 14 is reversed and the arm 26 used to swing the cover to one side. Since the flexible hoses 30 and 31 are attached to the cover, the hoses permit the movement of the cover without interfering with the removal of wire basket 40 containing the impregnated porous elements.

The treated and impregnated porous elements are carried in the basket to an appropriate area which permits them to be spread over a larger area to ensure that surface drying occurs prior to handling. The surface drying can be promoted by air movement apparatus if desired. The surface drying has been found to enhance the mechanical stability of the porous rock, which is typically a pumice, and also to permit handling of the rock without undue disturbance of the surface-located solution. The conditioned porous rock is then available for use in the rifling or stone-washing conditioning processes utilized with denim fabric. Typically this includes the addition of rocks to a tumbler containing dampened denim clothing. The reactive solution utilized in the process as described is a permanganate solution but it is to be noted that other solutions reactive with the fabric to be treated can be utilized if desired. The strength and composition of the reactive solution are dictated by the desired effect on the fabric being treated. As describe, the process using the permanganate requires the fabric to be subjected to a further wash containing a reducing agent or neutralizer. While the foregoing description has referred to a specific embodiment of the invention, it is recognized that variations and modification may be made therein without departing from the scope of the invention as claimed.

What is claimed is:

1. A process for the preparation of porous abrasive elements for use in the intentional distressing of fabric which comprises the following steps:

(a) placing a quantity of a porous abrasive rock in a vacuum vessel;

(b) reducing the pressure in said vessel to a reduced pressure which is less than ambient pressure;

(c) introducing a reactive solution which effects the fabric to be distressed and comprising 1 to 5% by weight of potassium or sodium permangante into said vessel to a level adequate to cover said rock;

(d) maintaining the pressure in said vessel at substantially said reduced pressure during an interval including the introduction of said reactive solution to said vessel;

(e) restoring the pressure within the vessel to approximately the ambient level; and (f) remove the impregnated rock from the vacuum vessel.

2. The invention in accordance with claim 1 further comprising the steps of:

(a) increasing the pressure within said vessel at the end of said interval to above ambient pressure; and (b) purging the reactive solution from the vessel prior to the restoration of the pressure therein to the ambient level.

3. The invention in accordance with claim 1 wherein the steps of restoring the pressure within said vessel and purging the reactive solution take place concurrently.

4. The invention in accordance with claim 3 further comprising the step of surface drying the solution impregnated rock prior to use in the distressing of fabric.

5. The invention in accordance with claim 2 wherein said reactive solution is introduced proximate to the bottom of said vessel.

6. The invention in accordance with claim 5 wherein the step of placing porous rock in a vacuum vessel includes maintaining said placed rock above the bottom surface of said vessel and introducing the solution beneath said placed rock.

7. The invention in accordance with claim 2 wherein said reduced pressure is within the range of 12 to 14 pounds per square inch below the ambient pressure.

8. The invention in accordance with claim 2 wherein said reduced pressure is approximately 12.25 pounds per square inch below the ambient pressure.

9. The invention in accordance with claim 7 wherein said interval is approximately 15 minutes.

10. The invention in accordance with claim 9 further comprising the steps of:

(a) increasing the pressure within said vessel at the end of the interval to above ambient pressure; and (b) purging the reactive solution from the vacuum vessel prior to the restoration of the pressure therein to the ambient level.

11. The invention in accordance with claim 10 wherein the step of increasing the pressure includes raising the pressure approximately 10 pounds per square inch above ambient pressure.

12. The invention in accordance with claim 11 wherein the steps of increasing the pressure within said vessel and purging the reactive solution take place concurrently.

13. The invention in accordance with claim 2 further comprising the step of surface draying the solution impregnated rock prior to use in distressing fabric.

14. Porous abrasive elements for use in the intentional distressing of fabric produced by the process of:

(a) placing a quantity of porous abrasive rock in a vacuum vessel;

(b) reducing the pressure in said vessel to a reduced pressure which is less than ambient pressure;

(c) introducing a reactive solution which effects the fabric to be distressed and comprising 1 to 5% by weight of potassium or sodium permanganate into said vessel to a level adequate to cover said rocks;

(d) maintaining the pressure in said vessel at substantially said reduced pressure during an interval including the introduction of said reactive solution to said vessel;

(e) restoring the pressure within the vessel to approximately the ambient level; and (f) remove the impregnated rock from the vacuum vessel.

* * * * *

UNITED STATES PATENT AND TRADEMARK OFFICE

CERTIFICATE OF CORRECTION

PATENT NO. : 4,850,156

DATED : July 25, 1989

INVENTOR(S) : David L. Bellaire

It is certified that error appears in the above-identified patent and that said Letters Patent is hereby corrected as shown below:

Page 6, line 63 delete "Claim 1" and insert --Claim 2--.

Page 8, line 8, delete "draying" and insert --drying--.

Page 8, line 19 change "rocks" to --rock--.

Signed and Sealed this

Nineteenth Day of November, 1991

*Attest:*

HARRY F. MANBECK, JR.

*Attesting Officer*

*Commissioner of Patents and Trademarks*